US006424306B1

(12) United States Patent
Militz et al.

(10) Patent No.: US 6,424,306 B1
(45) Date of Patent: Jul. 23, 2002

(54) WINDSHIELD ANTENNA

(75) Inventors: Uwe Militz; Carsten Zeitz, both of Berlin (DE)

(73) Assignee: Robert Bosch GmbH, Stuttgart (DE)

( * ) Notice: Subject to any disclaimer, the term of this patent is extended or adjusted under 35 U.S.C. 154(b) by 0 days.

(21) Appl. No.: 09/621,723

(22) Filed: Jul. 24, 2000

(30) Foreign Application Priority Data

Jul. 24, 1999 (DE) ..... 199 34 867

(51) Int. Cl.[7] ..... H01Q 1/32
(52) U.S. Cl. ..... 343/715; 343/713; 343/767
(58) Field of Search ..... 343/711, 713, 343/715, 767, 829, 846; H01Q 1/32

(56) References Cited

U.S. PATENT DOCUMENTS 4,621,243 A * 11/1986 Harada ..... 333/24 R
5,283,589 A * 2/1994 Blevins ..... 343/715
5,451,966 A 9/1995 Du et al. ..... 343/715
5,565,877 A * 10/1996 Du et al. ..... 343/715
5,585,809 A * 12/1996 Yajima et al. ..... 343/713
5,612,652 A * 3/1997 Crosby ..... 333/24 R
5,898,408 A * 4/1999 Du ..... 343/715

* cited by examiner

*Primary Examiner*—Tho Phan
(74) *Attorney, Agent, or Firm*—Kenyon & Kenyon

(57) ABSTRACT

A windshield antenna including, in particular, a multirange coupler for transmitting the L band and band III for DAB reception between an antenna base and a connecting module through a pane is described. An L band amplifier and/or printed circuit boards, whose surfaces facing the pane, which are designed to be conductive, form the capacitive transmitter, and whose opposite surfaces carry connecting and/or circuit elements, are provided in the connecting module. As an alternative or in addition, integration of a slot antenna in a capacitive transmitter can also be provided.

22 Claims, 3 Drawing Sheets

WINDSHIELD ANTENNA

FIELD OF THE INVENTION

The present invention generally relates to a windshield antenna.

BACKGROUND INFORMATION

Windshield antennas have been used for a variety of frequency ranges in vehicles, in particular, motor vehicles. They include an antenna base having a frequency-tuned (resonant) radiator glued to the outside of the window pane, in particular, a windshield, and a connecting module glued to the pane on the inside.

Signal transmission must take place between these two components through the pane.

In conventional windshield antennas, signals are transmitted through the pane capacitively using capacitor plates of different sizes. This coupling is particularly well-suited for frequencies from 140 kHz to approximately 1500 MHz. For signals above a frequency of 1500 MHz, capacitive coupling is ineffective since the capacitor plates themselves transmit through the pane. For low-loss coupling for signals having frequencies over 1500 MHz, slot antennas can be used as described in U.S. Pat. No. 5,451,966.

At low frequencies, the vehicle body, connected to the connecting module via a grounding strip, which should be as short as possible ($<<\lambda/4$), can be used as a reference ground. From approximately 400 MHz, tuned counterweights referred to as radials are used, which are glued to the pane on both sides of the connecting module. For coupling with slot antennas (over approximately 1500 MHz) the reference ground surrounds the slot.

Conventional combination antennas with a screwed-on antenna base are also available. For example, Bosch offers antennas for DAB (Digital Audio Broadcast), i.e., band III +L-band, antennas for C networks and D networks, i.e., 450 MHz +900 MHz and other combinations.

If DAB radio programs are to be received with a windshield antenna, a combination antenna must be used in all cases, since DAB programs are transmitted in "band III," i.e., between 174 and 240 MHz and "L band," i.e., between 1452 and 1492 MHz.

Cable damping for common antenna cables used in motor vehicles is approximately 0.2 dB/m in band III and approximately 0.8 dB/m in the L band. To compensate for this damping, it is advisable, especially in the L band, to use an antenna amplifier. Presently an active diplexer in a dedicated housing located at a distance from the windshield antenna is used.

SUMMARY OF THE INVENTION

An object of the present invention is to provide a windshield antenna (also referred to as an on-glass antenna) having a simple design in which the capacitive transmitter and the respective circuit and connecting elements are implemented in a simple manner. Furthermore or as an alternative, the windshield antenna according to the present invention may be capable of transmitting at least one frequency band below, as well as at least one frequency band above, a certain frequency such as, for example, 1450 MHz.

Furthermore or as an alternative, according to the present invention, a DAB windshield antenna having multirange couplers is to be provided, which properly receives not only band III, but also the L band.

The present invention can be used, in particular, for receiving radio programs in a DAB format (Digital Audio Broadcast). DAB is divided into the frequency bands: band III, 174 to 240 MHz, and L band, 1452 to 1492 MHz. Other applications of the present invention are for antennas for analog broadcasting +E network or D network +E network, for example.

In an exemplary embodiment according to the present invention, an L band amplifier is provided in the connecting module; thereby not only is a very compact design achieved, but also the L band signals, particularly affected by cable damping, are effectively amplified.

In another embodiment according to the present invention, printed circuit boards are provided in the antenna base and the connecting module whose surfaces facing the pane, which are designed to be conductive, form the capacitive transmitter, and whose opposite surfaces carry connecting and/or circuit elements. Thereby not only a particularly inexpensive design but also particularly short signal paths are achieved.

To couple two frequency bands, for example, one frequency band below and another frequency band above 1450 MHz, which are to be sent to or received by a combination antenna, through a pane, a slot antenna for the upper frequency band is combined with a capacitive coupling for the lower frequency band in the windshield antenna. It is advantageous if the conductive surface surrounding the slot antenna is used as capacitor plates for coupling the lower frequency band, the antenna rod being connected to the coupling elements on one side and the internal conductor of the common coaxial connecting cable being connected to the coupling elements on the other side of the pane, via a high/low-pass combination.

The conductive surface surrounding the slot is used as a reference ground for the upper frequency band. A grounding strip ($<<\lambda/4$) to the vehicle body is used for the lower frequency band at frequencies <400 MHz; at frequencies between 400 and 1450 MHz tuned radials are used. The reference grounds are connected to the external conductor of the common coaxial connecting cable via a high/low-pass combination. In the simplest case, these high/low-pass combinations can be implemented by one coil and one capacitor each.

Furthermore, according to the present invention, the antenna signals from the antenna base are picked off behind the pane in the connecting module of a DAB windshield antenna. This is achieved using capacitor plates for both frequency ranges or a combination of a capacitor plate for band III and a slot antenna for the L band. These coupling elements can be designed as printed circuit boards without any additional expense. The electronic components used for a frequency diplexer and an antenna amplifier are then mounted on this printed circuit board.

Another advantage of the present invention is that a windshield antenna can be designed as a combination antenna for two frequency bands, one below and the other above 1450 MHz. Thus only one antenna and one connecting cable is needed for transmitting two frequency bands without the use for drilling a hole for the cable feed-through.

It is advantageous that when frequencies <400 MHz and frequencies >1400 MHz (for example, DAB) are jointly transmitted, the view through the windshield is not negatively affected by glued-on radials.

Another advantage is that the connecting module of a windshield antenna can be equipped with an amplifier without using an additional component, i.e., an additional printed circuit board with mechanical brackets; this amplifier compensates for the damping of an antenna cable. In this manner, the additional costs for an antenna amplifier are minimized.

When the windshield antenna is used as a multirange antenna, it has a combination antenna rod which allows the reception of the desired frequency bands.

DETAILED DESCRIPTION

Figure 1:
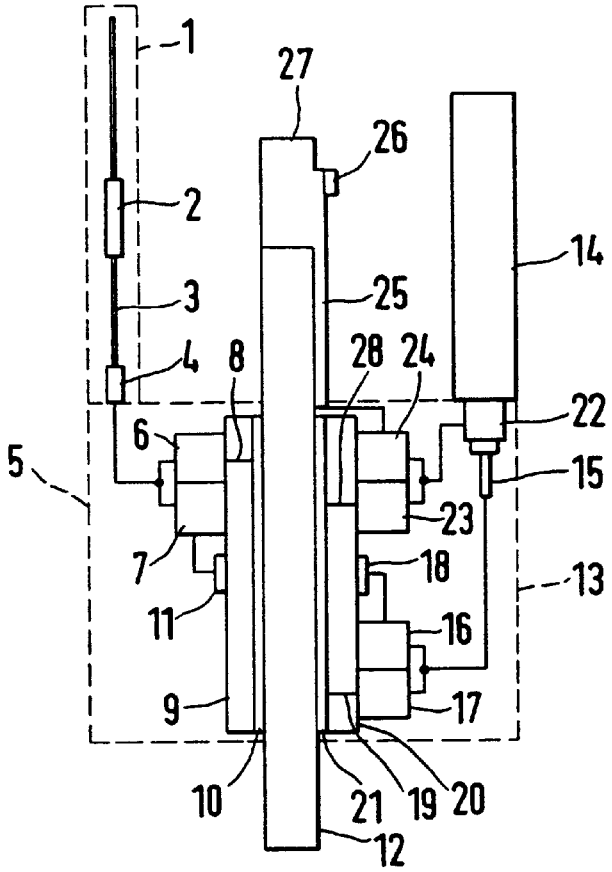
FIG. 1 shows the design of a first embodiment of a windshield antenna according to the present invention.

FIG. 1 schematically shows the design of a windshield antenna according to the present invention. Antenna rod 1 is divided into two zones by an isolating element 2, which may preferably be a coil. Bottom part 3 is used as the radiator for the upper frequency range, while the entire rod 1 is used as a radiator for the lower frequency range.

The radiator is connected to antenna base 5 by a mechanical coupling 4, preferably a screw thread; antenna base 5 is mounted on a pane 12 of a vehicle in a conventional manner.

Coupling 4 is furthermore electrically connected to the first gate of a low-pass filter 6 and to the first gate of a high-pass filter 7. The second gate of low-pass filter 6 is connected to a conductive surface 10 surrounding the slot via a through contact 8 through a printed circuit board 9. The second gate of high-pass filter 7 is connected to a supply line of a slot antenna 11.

In this design, the high frequencies of the upper band are sent to slot antenna 11 and the low frequencies of the lower band are sent to conductive surface 10 surrounding the slot.

A connecting module 13 is located on the opposite side of pane 12. Internal conductor 15 of connecting cable 14 is connected to the first gate of a high-pass filter 16 and to the first gate of a low-pass filter 17. The second gate of high-pass filter 16 is connected to a supply line of a slot antenna 18 on the inside of pane 12. The second gate of low-pass filter 17 is connected to a conductive surface 21 surrounding the slot via a through contact 19 through a printed circuit board 20.

In this manner, the high frequencies of the upper band are sent to the slot antenna and the lower frequencies of the lower band are sent to the conductive surface surrounding the slot.

External conductor 22 of a connecting cable 14 is connected to the first gate of a high-pass filter 23 and to the first gate of a low-pass filter 24. The second gate of low-pass filter 24 is connected to a grounding strip 25 which is conductively connected to the body of the vehicle. In the embodiment illustrated, the conductive connection with vehicle body 27 is implemented by a screw 26 above pane 12.

The reference ground for the low frequencies of the lower frequency band is transferred from vehicle body 27 to connecting module 13 by this arrangement. The second gate of high-pass filter 23 is connected to conductive surface 21 surrounding the slot via through contact 28. Thus this surface becomes the reference ground for the high frequencies of the upper band.

Figure 2:
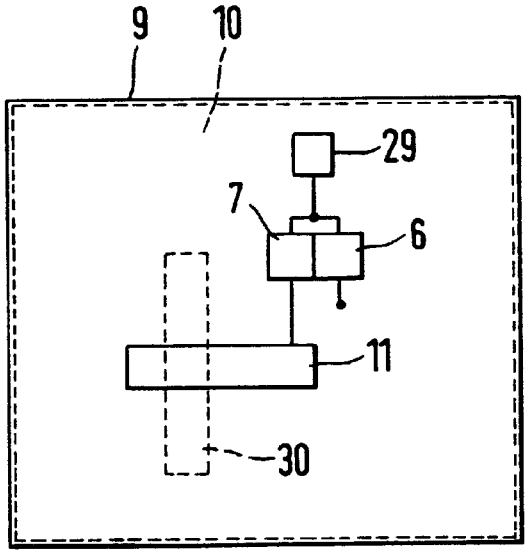
FIG. 2 shows the design of a printed circuit board mounted in the antenna base according to the present invention.

FIG. 2 schematically shows the design of printed circuit board 9, located in antenna base 5 on the outside of pane 12. Connecting point 29 is connected to coupling 4, which mechanically holds radiator 1. The function of elements 6, 7, 9, 10, and 11 has already been elucidated in the description of FIG. 1. In FIG. 2, slot 30 in conductive surface 10 for slot antenna 11 is illustrated. Slot 30 is located on the bottom side of printed circuit board 9.

Figure 3:
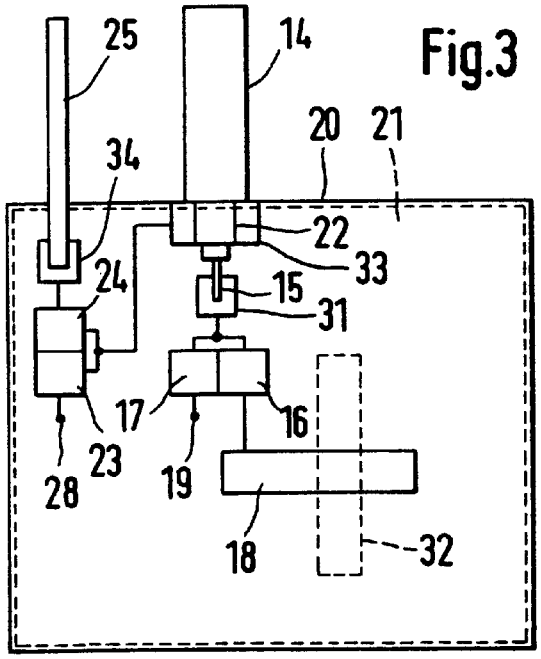
FIG. 3 shows the design of a printed circuit board mounted in the connecting module according to the present invention.

FIG. 3 shows a schematic diagram of printed circuit board 20, located in connecting module 13 on the inside of pane 12. Connecting point 31 for internal conductor 15 of connecting cable 14 is connected to elements 18 and 19, whose functions have been elucidated in the description of FIG. 1, via elements 16 and 17. In addition, in FIG. 3 a slot 32 in conductive surface 21 is shown. The slot 32 is located on the bottom side of printed circuit board 20. Connecting point 33 for external conductor 22 of cable 14 is connected to element 28 and to connecting point 34 for element 25, whose function has been elucidated in the description of FIG. 1, via elements 23 and 24.

Figure 4:
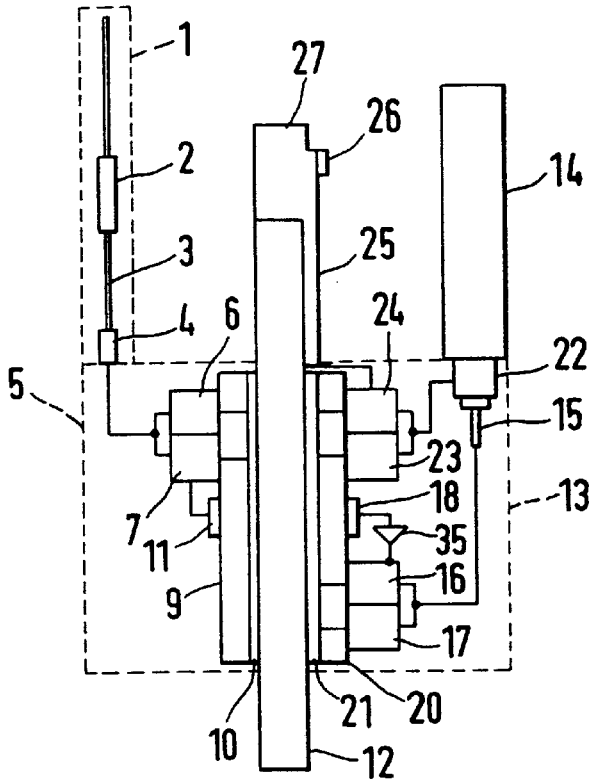
FIG. 4 shows a modification of the embodiment illustrated in FIG. 1 according to the present invention.

FIG. 4 shows a modification of the embodiment illustrated in FIG. 1 of a windshield antenna with a detailed design of the coupling elements and connecting cable. In this modification a capacitive coupling for band III and a slot antenna coupling for the L band is also used.

Antenna rod 1 is divided into two zones by an isolating element 2, preferably a coil, part 3 being the radiator for the upper frequency range and entire rod 1 being the radiator for the lower frequency range. The radiator is connected to antenna base 5 by a mechanical coupling 4, preferably a screw thread. This coupling is electrically connected to a first gate of a low-pass filter 6 and to a first gate of a high-pass filter 7, a second gate of low-pass filter 6 being connected to conductive surface 10 surrounding the slot via a through contact 8 through printed circuit board 9. A second gate of high-pass filter 7 is connected to supply line 11 of the slot antenna. In this manner the high frequencies of the upper band are sent to the slot antenna and the lower frequencies of the lower band are sent to the conductive surface surrounding the slot.

Connecting module 13 is located on the opposite side of pane 12. Supply line 18 of the slot antenna is connected to a first gate of high-pass filter 16 via amplifier 35. A second gate of the high-pass filter is connected to internal conductor 15 of connecting cable 14. In this manner the L band is transmitted through the pane, amplified, and sent to the cable separately from the lower band.

Conductive surface 21 surrounding the slot, which transmits band III capacitively, is connected to a first gate of low-pass filter 17 via through contact 19. A second gate of the low-pass filter is also connected to internal conductor 15 of connecting cable 14. The L band and band III are joined again here. External conductor 22 of connecting cable 14 is connected to a first gate of high-pass filter 23 and a first gate of low-pass filter 24. A second gate of low-pass filter 24 is connected to grounding strip 25, which is connected to vehicle body 27 via screw 26 above pane 12. Thus the reference ground for the lower frequencies of the lower frequency band is transferred from vehicle body 27 to connecting module 13. A second gate of high-pass filter 23 is connected to conductive surface 21 surrounding the slot via through contact 28. Thus this surface becomes the reference ground for the high frequencies of the upper band.

Figure 5:
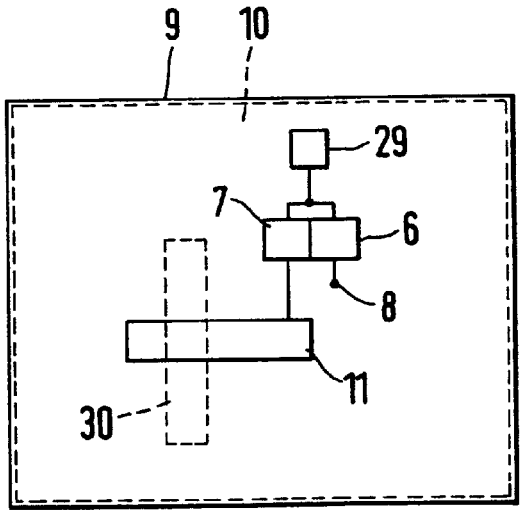
FIG. 5 shows the design of a printed circuit board mounted in the antenna base according to the present invention.

FIG. 5 schematically shows the design of printed circuit board 9, located in antenna base 5 on the outside of pane 12. Coupling 4 mechanically holding radiator 1 is connected to connecting point 29. The function of elements 6, 7, 9, 10 and 11 has been elucidated in the description of FIG. 4. FIG. 5 also shows slot 30 in conductive surface 10, located on the bottom side of the printed circuit board 9.

Figure 6:
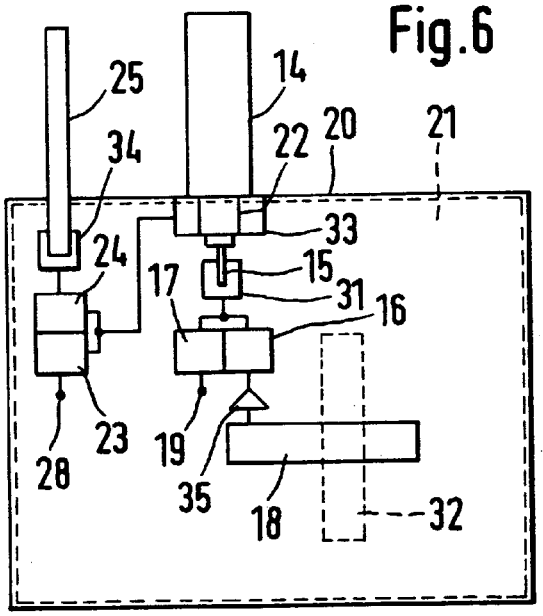
FIG. 6 shows the design of a printed circuit board mounted in the connecting module for the modification illustrated FIG. 4 according to the present invention.

FIG. 6 schematically shows the design of printed circuit board 20, located in connecting module 13 on the inside of pane 12. Slot 32 in conductive surface 21 is located on the bottom side of the printed circuit board. It is connected to connecting point 31 for internal conductor 15 of connecting cable 14 via elements 18, 35, and 16, whose function has been elucidated in the description of FIG. 4.

Connecting point 33 for external conductor 22 of cable 14 is connected to element 28 and connecting point 34 for element 25, whose function has been elucidated in the description of FIG. 4, via elements 23 and 24.

Figure 7:
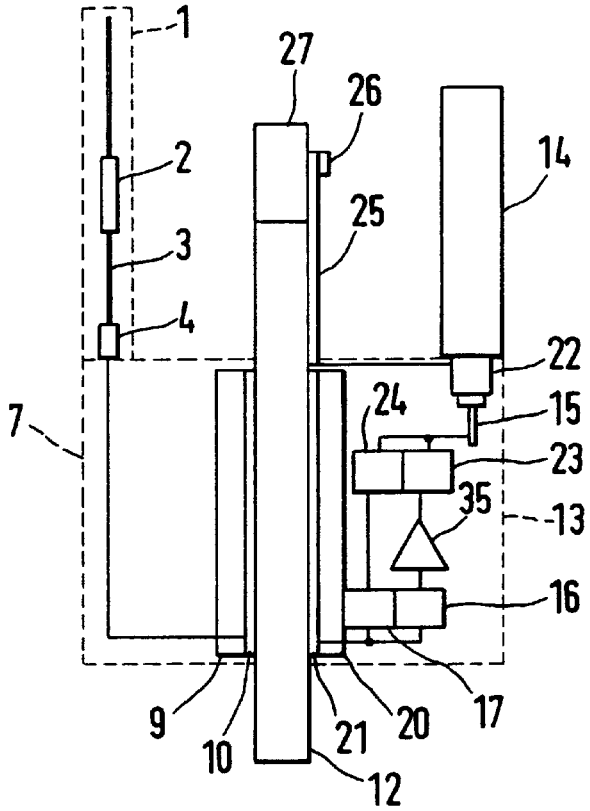
FIG. 7 shows the design of a second embodiment of a windshield antenna according to the present invention.

FIG. 7 shows the corresponding design for the embodiment according to the present invention in which both bands are capacitively coupled through the pane. Antenna 1 is directly connected to conductive surface 10 on the rear of printed circuit board 9 via through contact 8. Antenna signals capacitively transmitted are sent from conductive surface 21 of printed circuit board 20 on the inside of pane 12 via through contact 19 to high-pass filter 16 and low-pass filter 17. To amplify the L band alone, the second gate of high-pass filter 16 is connected to the input terminal of amplifier 35. The output terminal of amplifier 35 is connected to high-pass filter 23, whose second gate conducts the signal to internal conductor 15 of connecting cable 14. At this point the signals of the low-frequency band are also joined with the L band via low-pass filter 24.

Vehicle body 27, connected to grounding strip 25 via screw 26, which is connected in connecting module 13 to external conductor 22 of cable 14, is used as the reference ground for both frequency ranges in this example. A variant with glued-on counterweights, referred to as radials, is also possible for the L band.

Figure 8:
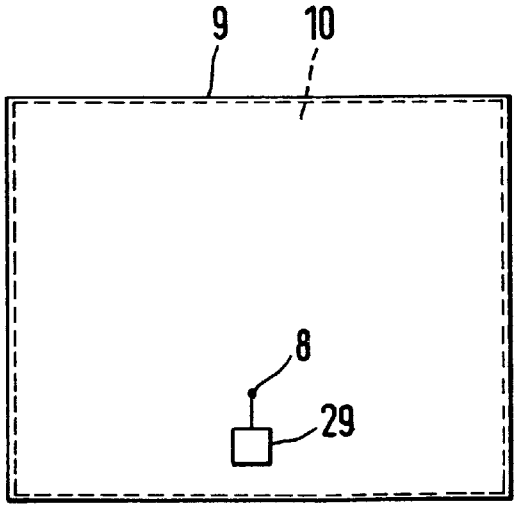
FIG. 8 shows the design of a printed circuit board mounted in the antenna base according to the present invention.
Figure 9:
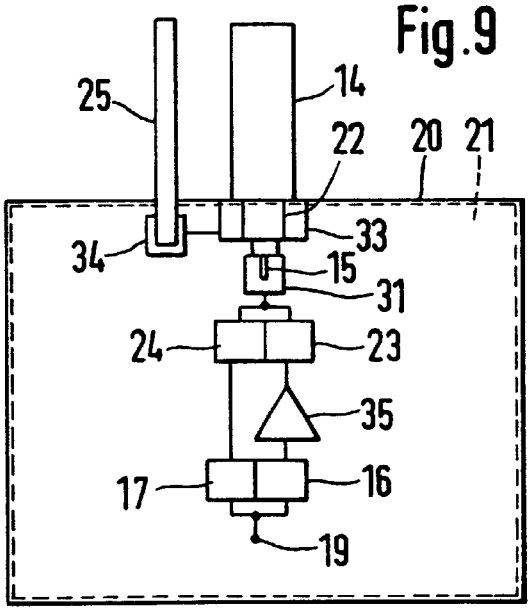
FIG. 9 shows the design of a printed circuit board mounted in the connecting module for the second embodiment according to the present invention.

FIGS. 8 and 9 show the design of printed circuit boards 9 and 20. Elements 29, 31, 33, and 34 are soldering surfaces, to which the terminals shown are soldered.

The present invention has been described and illustrated in terms of certain embodiments, other embodiments will become apparent to those of ordinary skill in the art in view of the disclosure herein. Accordingly, the present invention is not intended to be limited by the recitation of embodiments, but is intended to be defined solely by reference to the appended claims.

In particular, a multirange coupler can be obtained using the present invention, in which the conductive surface surrounding the slot antenna is used as a capacitor plate for coupling the lower frequency band, while the antenna rod on the one side and internal conductor of the common coaxial connecting cable on the other side of the pane are each connected to the coupling elements via a high-pass/low-pass filter combination.

The conductive surface surrounding the slot can also be used as the reference ground for the upper frequency band.

In particular, a DAB windshield antenna can be implemented with an integrated L band amplifier for simultaneous reception or simultaneous emission of a frequency band below and a frequency band above 1450 MHz.

In each case, according to the present invention, an L band amplifier and/or printed circuit boards are provided in the connecting module whose surfaces facing the pane, which are designed to be conductive, form the capacitive transmitter, and whose opposite surfaces carry connecting and/or circuit elements.

As an alternative or additionally, integration of a slot antenna in a capacitive transmitter can also be provided.

What is claimed is:

1. A windshield antenna, comprising:

an antenna base;

a connecting module including an L band amplifier; and a multirange coupler transmitting an L band and a band III for Digital Audio Broadcast (DAB) reception between the antenna base and the connecting module through a pane.

2. The windshield antenna according to claim 1, wherein the antenna base includes a first printed circuit board, a first surface of the first printed circuit board facing the pane and being conductive, wherein the connecting module includes a second printed circuit board, a second surface of the second printed circuit board facing the pane and being conductive, and wherein the first surface and the second surface form a capacitive transmitter, the capacitive transmitter transmitting signals between the antenna base and the connecting module through the pane.

3. The windshield antenna according to claim 2, wherein the signals transmitted by the capacitive transmitter include a first set of frequencies and a second set of frequencies, the first set including frequencies below a predetermined frequency, the second set including frequencies above the predetermined frequency, and wherein the connecting module includes a first frequency diplexer, a second frequency diplexer and an amplifier, the first frequency diplexer dividing the transmitted signals into the first set and the second set of frequencies, the amplifier amplifying the second set of frequencies, the second frequency diplexer combining the first set of frequencies and the second set of frequencies.

4. The windshield antenna according to claim 3, wherein the predetermined frequency is approximately 1450 MHz.

5. The windshield antenna according to claim 3, wherein the first frequency diplexer and the second frequency diplexer include a high-pass filter and a low pass filter.

6. The windshield antenna according to claim 2, wherein the connecting module includes a first frequency diplexer, a second frequency diplexer and a slot antenna, the first frequency diplexer dividing the transmitted signals into a first set of frequencies and a second set of frequencies, the first set including frequencies below a predetermined frequency, the second set including frequencies above the predetermined frequency, the second frequency diplexer combining the first set and the second set of frequencies, the slot antenna transmitting the second set of frequencies through the pane, and wherein the capacitive transmitter transmits the first set of frequencies.

7. The windshield antenna according to claim 6, wherein the predetermined frequency is approximately 1450 MHz.

8. The windshield antenna according to claim 2, wherein the capacitive transmitter includes a reference ground that is at least one of a radial and a body of a vehicle.

9. The windshield antenna according to claim 8, wherein the connecting module is coupled to the body of the vehicle via a grounding strip.

10. The windshield antenna according to claim 2, wherein the first surface includes a first slot, wherein the second surface includes a second slot, and wherein the first slot and the second slot form a slot antenna.

11. The windshield antenna according to claim 10, wherein the first surface and the second surface are a reference ground for the slot antenna.

12. The windshield antenna according to claim 2, further comprising:

an antenna coupling coupled to the first printed circuit board, wherein the first printed circuit board includes a first low-pass filter and a first high-pass filter, the antenna coupling being coupled to a first gate of the first low-pass filter and to a first gate of the first high-pass filter, a second gate of the first low-pass filter being coupled to the first surface via a first through contact through the first printed circuit board, a second gate of the first high-pass filter being coupled to a supply line for a first slot antenna.

13. The windshield antenna according to claim 12, further comprising:

a connecting cable including an internal conductor, wherein the second printed circuit board includes a second low-pass filter and a second high-pass filter, the internal conductor being coupled to a first gate of the second high-pass filter and to a first gate of a second low-pass filter, a second gate of the second high-pass filter being coupled to a supply line of a second slot antenna, a second gate of the second low-pass filter being coupled to the second surface via a second through contact through the second printed circuit board.

14. The windshield antenna according to claim 13, wherein the second printed circuit board includes a third low-pass filter and a third high-pass filter, and wherein the connecting cable includes an external conductor, the external conductor being coupled to a first gate of the third high-pass filter and to a first gate of the third low-pass filter, a second gate of the third low-pass filter being coupled to a body of a vehicle.

15. The windshield antenna according to claim 14, wherein a second gate of the third high-pass filter is coupled to the second surface via a third through contact.

16. The windshield antenna according to claim 2, further comprising:

a grounding strip to a body of a vehicle used as a reference ground for frequencies less than approximately 400 MHz, the grounding strip being as short as possible and being less than a quarter wavelength;

a tuned radial used as the reference ground for frequencies between approximately 400 MHz and 1450 MHz, the reference ground being coupled to an external conductor of a coaxial connecting cable via a high-pass/low-pass combination.

17. The windshield antenna according to claim 16, wherein the high-pass/low-pass combination is formed by a coil and a capacitor.

18. The windshield antenna according to claim 1, further comprising:

an antenna rod coupled to the antenna base, the antenna rod being divided into a first zone and a second zone via an isolating element, the first zone including a bottom part of the antenna rod and radiates a first set of frequencies, the first zone and the second zone together radiate a second set of frequencies, the first set including frequencies above a predetermined frequency, the second set including frequencies below the predetermined frequency.

19. The windshield antenna according to claim 18, wherein the isolating element is a coil.

20. A windshield antenna, comprising:

an antenna base;

a connecting module;

a capacitive transmitter transmitting signals between the antenna base and the connecting module through a pane; and a multirange coupler transmitting an L band and a band III for Digital Audio Broadcast (DAB) reception between the antenna base and the connecting module through the pane;

wherein the antenna base includes a first printed circuit board, a first surface of the first printed circuit board facing the pane and being conductive, wherein the connecting module includes a second printed circuit board, a second surface of the second printed circuit board facing the pane and being conductive, and wherein the first surface and the second surface form the capacitive transmitter.

21. A windshield antenna, comprising:

an antenna base;

a connecting module; and a multirange coupler transmitting at least one frequency band under and at least one frequency band over a predetermined frequency between the antenna base and the connecting module through a pane;

wherein the multirange coupler includes a first frequency diplexer, a second frequency diplexer and a slot antenna, the first frequency diplexer dividing the transmitted signals into a first set of frequencies and a second set of frequencies, the first set including frequencies below a predetermined frequency, the second set including frequencies above the predetermined frequency, the second frequency diplexer combining the first set and the second set of frequencies, the slot antenna transmitting the second set of frequencies through the pane, and wherein a capacitive transmitter transmits the first set of frequencies.

22. The windshield antenna according to claim 21, wherein the multirange coupler transmits signals between the antenna base and the connecting module in both directions.

* * * * *